US011327423B2

(12) United States Patent
Shinji et al.

(10) Patent No.: US 11,327,423 B2
(45) Date of Patent: May 10, 2022

(54) IMAGE FORMING APPARATUS

(71) Applicant: Canon Kabushiki Kaisha, Tokyo (JP)

(72) Inventors: Takeshi Shinji, Kanagawa (JP); Satoshi Nishida, Kanagawa (JP); Isamu Takeda, Tokyo (JP); Takanori Mitani, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/335,471

(22) Filed: Jun. 1, 2021

(65) Prior Publication Data

US 2021/0373469 A1 Dec. 2, 2021

(30) Foreign Application Priority Data

Jun. 2, 2020 (JP) ..... JP2020-096185

(51) Int. Cl.
*G03G 15/20* (2006.01)

(52) U.S. Cl.
CPC ..... *G03G 15/2039* (2013.01)

(58) Field of Classification Search
CPC ..... G03G 15/2039
See application file for complete search history.

(56) References Cited

U.S. PATENT DOCUMENTS

| | | | | |
|---|---|---|---|---|
| 9,122,212 | B2 | 9/2015 | Fujimoto et al. | |
| 2002/0164173 | A1* | 11/2002 | Osada | G03G 15/5008 399/45 |
| 2014/0219696 | A1 | 8/2014 | Fujimoto et al. | |
| 2018/0004135 | A1* | 1/2018 | Sako | G03G 15/2039 |
| 2021/0191294 | A1 | 6/2021 | Nishida et al. | |

FOREIGN PATENT DOCUMENTS

| | | | |
|---|---|---|---|
| JP | 2001209291 | A | 8/2001 |
| JP | 2003050519 | A | 2/2003 |
| JP | 2009063826 | A | 3/2009 |
| JP | 2014153507 | A | 8/2014 |

* cited by examiner

*Primary Examiner* — Clayton E. LaBalle
*Assistant Examiner* — Michael A Harrison
(74) *Attorney, Agent, or Firm* — Venable LLP

(57) ABSTRACT

An image forming apparatus, includes: an image forming portion configured to form a toner image on a recording material according to image information on a predetermined image; a fixing portion configured to fix the toner image on the recording material by heating the recording material having thereon the toner image while conveying the recording material by a nip portion; an acquisition portion configured to acquire an image end position that is a position of one end of the toner image in a main scanning direction perpendicular to a conveying direction of the recording material; a determination portion configured to determine a target temperature based on the image end position; and a control portion configured to control the fixing portion based on the target temperature.

11 Claims, 11 Drawing Sheets

IMAGE FORMING APPARATUS

BACKGROUND OF THE INVENTION

Field of the Invention

The present invention relates to an image forming apparatus provided with a heating/fixing apparatus such as a printer and a copier.

Description of the Related Art

Image forming apparatuses of an electrophotographic system, for example, a printer or a copier include an image forming portion for forming a toner image on a recording material on the basis of image information, and a fixing portion (heating/fixing apparatus) for thermally fixing an unfixed toner image on the recording material. A system for determining ease of image fixation on the basis of image information and controlling a target temperature (fixation temperature) is known.

Japanese Patent Application Publication No. 2001-209291 discloses an image forming apparatus that determines the size of a recording material in a direction perpendicular to the conveying direction of the recording material on the basis of image information and controls the feeding intervals of the recording material on the basis of the determined size of the recording material. Japanese Patent Application Publication No. 2014-153507 discloses reducing excessive thermal energy by selectively heating a toner image formed on a recording material.

Heating on a recording material by the fixing portion of an image forming apparatus may cause a temperature difference between a central portion and an end of the recording material in a main scanning direction perpendicular to the conveying direction of the recording material. Because of the temperature difference between a central portion and an end of the recording material in the main scanning direction, an excessively high target temperature may be selected for an end position of a toner image in the main scanning direction. An object of the present invention is to reduce power consumption by determining a proper target temperature.

SUMMARY OF THE INVENTION

In order to achieve the object described above, an image forming apparatus according to the present invention includes: an image forming portion configured to form a toner image on a recording material according to image information on a predetermined image; a fixing portion configured to fix the toner image on the recording material by heating the recording material having thereon the toner image while conveying the recording material by a nip portion; an acquisition portion configured to acquire an image end position that is a position of one end of the toner image in a main scanning direction perpendicular to a conveying direction of the recording material; a determination portion configured to determine a target temperature based on the image end position; and a control portion configured to control the fixing portion based on the target temperature.

Power consumption can be reduced by determining a proper target temperature. Further features of the present invention will become apparent from the following description of exemplary embodiments with reference to the attached drawings.

DESCRIPTION OF THE EMBODIMENTS

Embodiments of the present invention will be specifically described below with reference to the accompanying drawings. However, the dimensions, materials, shapes, and relative arrangements of components described in the embodiments may be optionally changed according to conditions and a configuration to which the invention is applied. The scope of the invention is not intended to be limited to the following embodiments.

Embodiment 1

Figure 1:
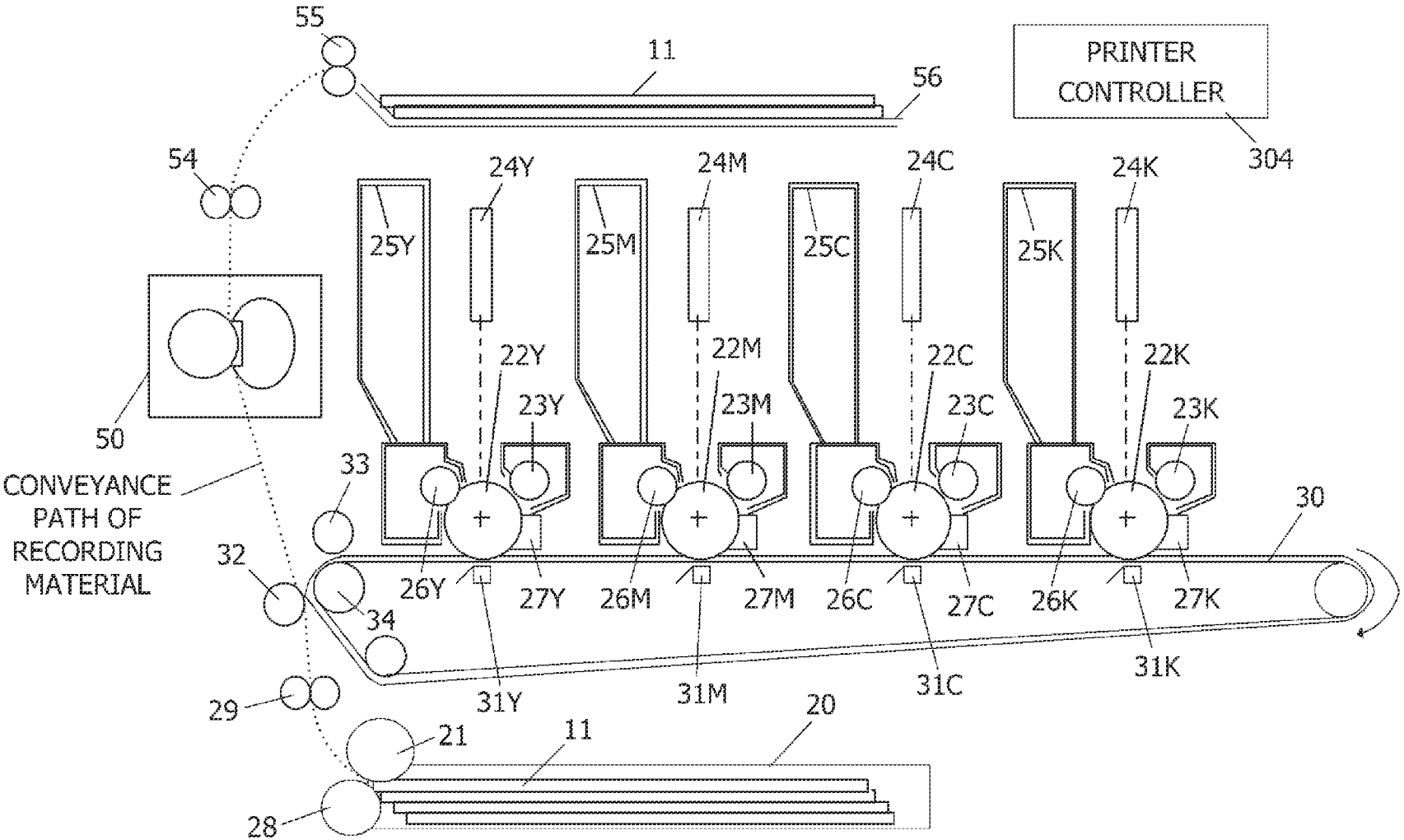
FIG. 1 is a schematic diagram illustrating an image forming apparatus according to Embodiment 1.

Referring to FIGS. 1 to 11A to 11C and 14A and 14B, Embodiment 1 will be described below. FIG. 1 is a schematic diagram illustrating a color image forming apparatus of an in-line system as an example of an image forming apparatus of an electrophotographic system. Referring to FIG. 1, the operations of the color image forming apparatus (hereinafter will referred to as an image forming apparatus) of the electrophotographic system will be described below. The image forming apparatus includes a paper feeding portion 20, photosensitive members (hereinafter will be referred to as photosensitive drums) 22 (22Y, 22M, 22C, 22K), and charging devices 23 (23Y, 23M, 23C, 23K), the photosensitive members and charging devices being provided for the respective stations of development colors. The image forming apparatus further includes toner cartridges 25 (25Y, 25M, 25C, 25K) and developing devices 26 (26Y, 26M, 26C, 26K). The image forming apparatus further includes an intermediate transfer member 30, primary transfer means 31 (31Y, 31M, 31C, 31K), a secondary transfer roller 32, residual toner charging means 33, and a fixing portion (heating/fixing apparatus) 50.

Exposure controlled by a printer controller 304 based on an image signal forms an electrostatic latent image on the photosensitive drum 22, and then the electrostatic latent image is developed to form a monochrome toner image on the photosensitive drum 22. Monochrome toner images are superimposed on top of one another to form a multicolor toner image, and then the multicolor toner image is transferred to a recording material (recording medium) 11. The multicolor toner image is fixed to the recording material 11 by applying heat and a pressure to the recording material 11 in the fixing portion 50, so that the multicolor toner image (picture) is formed on the recording material 11.

The photosensitive drum 22 is configured such that an aluminum cylinder is coated with an organic photoconductive layer. A driving force of a drive motor, which is not illustrated, is transmitted to rotate the photosensitive drum 22 counterclockwise. The image forming apparatus includes, as charging means, the four charging devices 23Y, 23M, 23C, and 23K for charging the photosensitive drums 22 of yellow (Y), magenta (M), cyan (C), and black (K) for each station. The surfaces of the photosensitive drums 22Y, 22M, 22C, and 22K are selectively exposed by laser beams emitted from laser scanners 24Y, 24M, 24C, and 24K, thereby forming an electrostatic latent image. For the visualization of the electrostatic latent image, the image forming apparatus includes the four developing devices (developing means) 26Y. 26M, 26C, and 26K that develop yellow (Y), magenta (M), cyan (C), and black (K) for each station. The developing devices 26Y, 26M, 26C, and 26K are configured so as to come into contact with or separate from the photosensitive drums 22Y, 22M, 22C, and 22K by means of a separating mechanism, which is not illustrated.

The intermediate transfer member 30 includes a resin seamless belt in contact with the photosensitive drums 22Y, 22M, 22C, and 22K. The intermediate transfer member 30 is rotated clockwise by a drive motor, which is not illustrated. The intermediate transfer member 30 rotates according to the rotations of the photosensitive drums 22Y, 22M, 22C, and 22K in response to an image forming operation. A voltage is applied to the primary transfer means 31Y, 31M, 31C, and 31K, thereby sequentially transferring monochrome toner images to the intermediate transfer member 30 (primary transfer). Untransferred toner on the photosensitive drums 22Y, 22M, 22C, and 22K is collected by cleaning means 27Y, 27M, 27C, and 27K provided for the respective photosensitive drums 22Y, 22M, 22C, and 22K.

The recording material 11 prepared in advance in the paper feeding portion 20 is fed by a feed roller 21 and a retard roller 28 and then is conveyed by resist rollers 29 holding the recording material 11. Thereafter, the intermediate transfer member 30 and the secondary transfer roller 32 provided in contact with the intermediate transfer member 30 convey the recording material 11 held therebetween. A voltage applied to the secondary transfer roller 32 transfers a multicolor toner image from the intermediate transfer member 30 to the recording material 11 (secondary transfer). The configuration for forming a toner image on the recording material 11 will be referred to as an image forming portion for forming a toner image on the recording material 11 according to image information on a predetermined image. As described above, the image forming apparatus is provided with the image forming portion that includes the photosensitive drums 22 acting as image bearing members, the charging devices 23 acting as charging members, the laser scanners 24 acting as exposing members, the developing devices 26 acting as developing members, and the intermediate transfer member 30 acting as a transfer member.

The residual toner charging means 33 charges toner left on the intermediate transfer member 30. After the transfer of a multicolor toner image onto the recording material 11, toner left on the intermediate transfer member 30 is charged with the opposite polarity of an original polarity by the residual toner charging means 33. The left toner is then electrostatically collected onto the photosensitive drums 22 by the primary transfer means 31 and then is collected by the cleaning means 27(27Y, 27M, 27C, and 27K). The fixing portion 50 fuses a multicolor toner image transferred onto the recording material 11 while conveying the held recording material 11. The detailed configuration of the fixing portion 50 will be described later. The recording material 11 with the fixed multicolor toner image is ejected to an ejection tray 56 by ejection rollers 54 and 55, completing the image forming operations.

Figure 2:
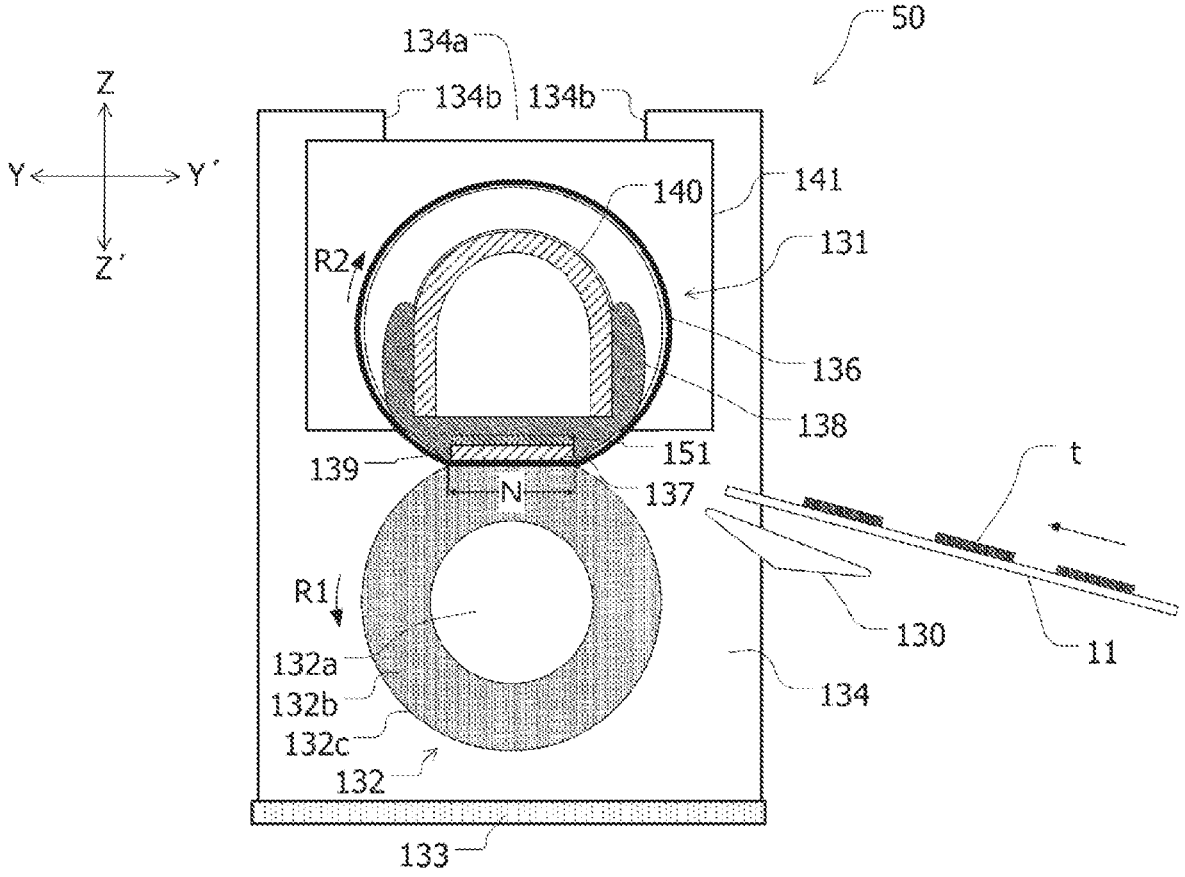
FIG. 2 is a schematic cross-sectional view illustrating a fixing portion according to Embodiment 1.
Figure 3:
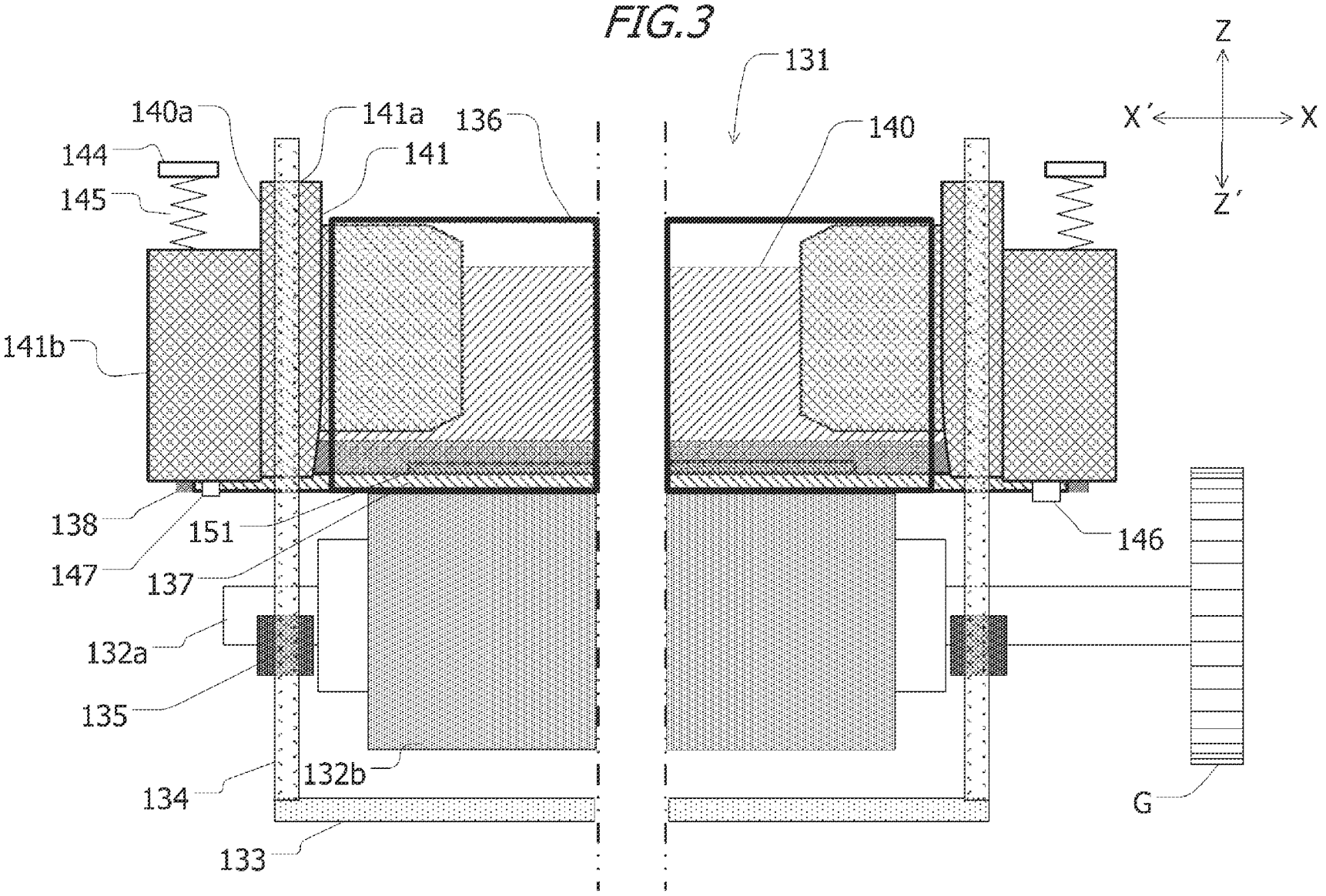
FIG. 3 is a schematic front view illustrating the fixing portion according to Embodiment 1.

Referring to FIGS. 2 to 7A and 7B, the configuration of the fixing portion 50 will be described below. FIG. 2 is a schematic cross-sectional view illustrating the principal part of the fixing portion 50. FIG. 3 is a schematic front view illustrating a part of the fixing portion 50. In the following description of the unit configuration, the longitudinal direction (the bus direction of a fixing film 136) indicates the X-axis direction of the drawing, the width direction indicates the Y-axis direction, which is the conveying direction of the recording material, and the height direction is the Z-axis direction. Moreover, the in-plane direction indicates a plane formed by the X axis and the Y axis, whereas the thickness direction indicates the Z-axis direction.

The fixing portion 50 acting as an image heating portion fuses a transferred multicolor toner image onto the recording material 11 while conveying the recording material 11. The fixing portion 50 has a film assembly 131 including the fixing film 136 acting as a flexible rotating member and a pressure roller 132 acting as a pressing member for pressing the recording material 11 to the fixing film 136. The film assembly 131 is provided in the upper part while the pressure roller 132 is provided in the lower part between left and right unit-frame side plates 134 of a unit frame 133. The film assembly 131 and the pressure roller 132 are disposed substantially in parallel with each other.

The pressure roller 132 includes a cored bar 132*a*, an elastic layer 132*b* that is made of, for example, silicone rubber or fluorocarbon rubber and is concentrically formed like a roller around the cored bar 132*a*, and a mold releasing layer 132*c* that is made of, for example, PFA, PTFE, or FEP on the elastic layer 132*b*. The pressure roller 132 used in the present embodiment is configured such that the elastic layer 132*b* having a thickness of about 3.5 mm is formed by injection molding on the stainless-steel cored bar 132*a* having an outside diameter of 11 mm and is coated with the mold releasing layer 132*c* having a thickness of about 40 μm. The pressure roller 132 has an outside diameter of 18 mm.

The hardness of the pressure roller 132 is preferably at least 40° and not more than 70° with a weight of 9.8 N measured with an ASKER-C hardness tester, in view of the provision of a fixing nip portion N and durability. In the present embodiment, the hardness of the pressure roller 132 is 54°. The pressure roller 132 has a rubber surface (mold releasing layer 132*c*) that measures 226 mm in the longitudinal direction. As illustrated in FIG. 3, the pressure roller 132 is rotatably supported between the unit-frame side plates 134 via respective bearing members 135 on both ends of the cored bar 132*a* in the longitudinal direction. On one end of the cored bar 132*a* of the pressure roller 132, a drive gear G is provided while being fixed to the cored bar 132*a*. The pressure roller 132 is rotated by a turning force transmitted to the drive gear G from a drive mechanism, which is not illustrated.

As illustrated in FIG. 2, the film assembly 131 includes the fixing film 136 and a heater unit 139 including a ceramic heater (hereinafter will be referred to as a heater) 137 acting as a heating element for heating the fixing film 136. The cylindrical fixing film 136 in contact with the recording material 11 accommodates a plate-like heater (heating portion) 137. The pressure roller 132 forms the fixing nip portion N with the heater 137 with the fixing film 136 interposed between the pressure roller 132 and the heater 137. Hence, the fixing portion 50 has the fixing nip portion N between the fixing film 136 and the pressure roller 132. The recording material 11 having a toner image t (multicolor toner image) is conveyed by the fixing nip portion N and is heated and pressurized, so that the toner image t is fixed to the surface of the recording material 11. In this way, the heater 137 heats the recording material 11 through the fixing film 136, and the toner image formed on the recording material 11 is fixed to the recording material 11 by heat of the heater 137. The film assembly 131 further includes a heater holder 138 that guides the fixing film 136 from the inside and serves as a support member for supporting the heater 137, and a metal plate 151. The film assembly 131 further includes a pressure stay 140 and left and right fixing flanges 141 acting as restricting members for restricting a movement of the fixing film 136 in the longitudinal direction. As described above, the heater unit 139 and the heater holder 138 are separated from each other. The heater unit 139 may include the heater 137 and the heater holder 138.

The fixing film 136 includes a base layer, an elastic layer, and a mold releasing layer. The fixing film 136 has flexibility. In the present embodiment, the base layer is a cylindrical substrate made of polyimide with a thickness of 60 μm. A silicone rubber layer having a thickness of about 150 μm is formed as the elastic layer on the base layer, and a PFA resin tube having a thickness of 15 μm is applied as the mold releasing layer on the elastic layer. The fixing film 136 has an inside diameter of 18 mm.

The heater holder 138 guides the fixing film 136 from the inside and supports the heater 137. As illustrated in FIG. 2, the heater holder 138 is a member that is substantially shaped like a semicircular chute in cross section with stiffness, heat resistance, and heat insulating properties and is made of liquid crystal polymers. The heater holder 138 acts as a rotating guide for the fixing film 136 fit onto the heater holder 138, a heat insulator for the heater 137, and a pressurizing opposed member for the pressure roller 132.

Figure 4:
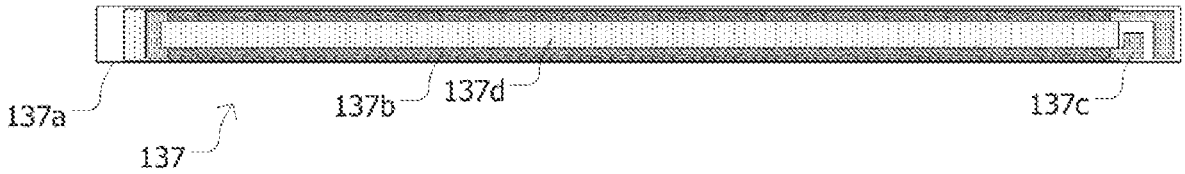
FIG. 4 is an explanatory drawing illustrating a heater according to Embodiment 1.

As illustrated in FIG. 4, the heater 137 includes heat generating resistors 137*b* that are made of materials such as silver and a palladium alloy and are formed on a substrate 137*a* by screen printing or the like, and an electrode 137*c* made of materials such as silver is connected to the heat generating resistor 137*b*. The substrate 137*a* is a ceramic substrate containing, for example, alumina and aluminum nitride. The two heat generating resistors 137*b* are connected in series. The heat generating resistors 137*b* have a resistance value of 18Ω. A glass coating 137*d* applied to the heat generating resistors 137*b* protects the heat generating resistors 137*b* and obtains sliding properties with the fixing film 136. The heater 137 is longitudinally disposed on the underside of the heater holder 138.

Figure 5:
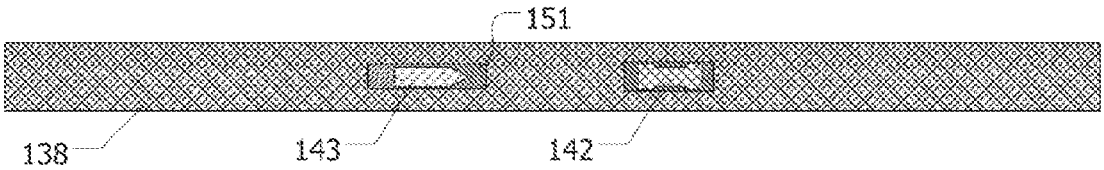
FIG. 5 is an explanatory drawing illustrating a thermistor and a thermal fuse according to Embodiment 1.

FIG. 5 is a top view illustrating a safety element and a temperature sensor that are mounted on the heater holder 138. The heater holder 138 has through holes. A thermistor 142 acting as a temperature sensor and a thermal fuse 143 acting as a safety element are brought into contact with the backside of the metal plate 151 from the respective through holes. A thermistor element is disposed on the housing of the thermistor 142 with ceramic paper or the like for stabilizing a state of contact with the heater 137 and is coated with an insulator such as polyimide tape.

The thermal fuse 143 is an overheat protection component that detects abnormal heat of the heater 137 in the event of an abnormal temperature rise of the heater 137 and interrupts the primary circuit of the heater 137. The cylindrical metallic housing of the thermal fuse 143 accommodates a fuse element that melts at a predetermined temperature. During an abnormal temperature rise of the heater 137, the fuse element melts so as to interrupt the primary circuit of the heater 137. A portion in contact with the heater 137 on the metallic housing of the thermal fuse 143 is about 10 mm in length while the metallic housing of the thermal fuse 143 is about 4 mm in width. The thermal fuse 143 is disposed on the backside of the metal plate 151 with thermal conductive grease, thereby preventing a malfunction caused by separation of the thermal fuse 143 from the heater 137.

The heater 137 rapidly rises in temperature due to power supply to the heat generating resistors 137*b* from the electrode 137*c* that serves as a feeding portion provided on one end of the substrate 137*a*. Subsequently, the temperature of the heater 137 is detected by the thermistor 142, and then a control portion, which will be described later, controls power supply from the electrode 137*c* to the heat generating resistors 137*b* so as to keep the heater 137 at a predetermined temperature.

The pressure stay 140 is a horizontally oriented rigid member having a reversed U shape in cross section. Stainless steel having a thickness of 1.6 mm is used as the material of the pressure stay 140. As illustrated in FIG. 3, the heater 137 is attached to the underside of the heater holder 138, the fixing film 136 is placed over the heater holder 138, and the pressure stay 140 is inserted into the heater holder 138. Left and right fixing flanges 141 are fit onto the respective left and right arm portions of the pressure stay 140, the arm portions extending to the outside. The film assembly 131 is assembled thus.

As illustrated in FIG. 2, the film assembly 131 is disposed on the pressure roller 132 substantially in parallel with the pressure roller 132 while the heater 137 of the film assembly 131 is placed face down. In this case, as illustrated in FIG. 3, the film assembly 131 is disposed between the left and right unit-frame side plates 134 of the unit frame 133. A vertical groove portion 141*a* on each of the left and right fixing flanges 141 is engaged with a vertical edge portion 134*b* of a vertical guide slit 134*a* provided on each of the left and right unit-frame side plates 134 of the unit frame 133. The fixing flanges 141 are made of liquid crystal polymer resin.

As illustrated in FIG. 3, a pressure spring 145 is compressed between a pressure arm 144 and a pressure portion 141*b* of each of the left and right fixing flanges 141. Thus, the heater 137 is pressed onto the top surface of the pressure roller 132 with a predetermined pressing force via the left and right fixing flanges 141, the pressure stay 140, and the heater holder 138 with the fixing film 136 interposed between the heater 137 and the pressure roller 132. In the present embodiment, the pressure of the pressure spring 145 is set such that the fixing film 136 and the pressure roller 132 have a pressing force of 160 N in total. The pressure presses the heater 137 onto the top surface of the pressure roller 132 against the elasticity of the fixing film 136 and the elasticity of the pressure roller 132 with the fixing film 136 interposed between the heater 137 and the pressure roller 132, thereby forming the fixing nip portion N of about 6 mm. In the fixing nip portion N, the heater unit 139 including the heater 137 is in contact with the inner surface of the fixing film 136. Specifically, in the fixing nip portion N, the fixing film 136 interposed between the heater 137 and the pressure roller 132 is deformed along a flat surface on the underside of the heater 137, and the inner surface of the fixing film 136 is in contact with the flat surface on the underside of the heater 137.

A turning force is transmitted to the drive gear G of the pressure roller 132 from the drive mechanism, which is not illustrated, thereby rotating the pressure roller 132 at a predetermined speed along an arrow R1 (counterclockwise) in FIG. 2. In response to the rotation of the pressure roller 132, a friction force between the pressure roller 132 and the fixing film 136 in the fixing nip portion N applies a turning force to the fixing film 136. Thus, the fixing film 136 is rotated by the rotation of the pressure roller 132 around the heater holder 138 along an arrow R2 (clockwise) in FIG. 2 while the inner surface of the fixing film 136 slides in contact with the underside of the heater 137. The inner surface of the fixing film 136 is coated with heat-resistant grease, ensuring sliding properties between the heater 137 and the heater holder 138 and the inner surface of the fixing film 136.

The fixing film 136 is rotated in response to the rotation of the pressure roller 132, and then the heater 137 is energized so as to be kept at a predetermined temperature. In this state, the recording material 11 is introduced. An inlet guide 130 acts as a guide for the recording material 11 such that the recording material 11 having the unfixed toner image t is correctly guided to the fixing nip portion N.

The recording material 11 having the unfixed toner image t is introduced between the fixing film 136 and the pressure roller 132 in the fixing nip portion N. The recording material 11 is held and conveyed by the fixing nip portion N while a surface of the recording material 11 is in contact with the outer surface of the fixing film 136 in the fixing nip portion N, the surface bearing the toner image t. In the holding and conveying process, heat from the fixing film 136 heated by the heater 137 is applied to the recording material 11, so that the unfixed toner image t on the recording material 11 is fused with heat and a pressure on the recording material 11. The recording material 11 having passed through the fixing nip portion N is ejected after being stripped with a curvature from a surface of the fixing film 136, and then the recording material 11 is conveyed by an ejection roller pair, which is not illustrated.

The substrate 137*a* of the heater 137 is a rectangular solid that is 26 W mm in length, 5.8 mm in width, and 1.0 mm in thickness. The heat generating resistor 137*b* on the substrate 137*a* is 220 mm in length. Also in the case of the recording material 11 (216 mm in width in the present embodiment) having a maximum size usable for the image forming apparatus including the fixing portion 50, the heat generating resistor 137*b* is longitudinally extended larger than the width of the recording material 11 in order to uniformly fix the toner image t on the recording material 11.

Figure 6:
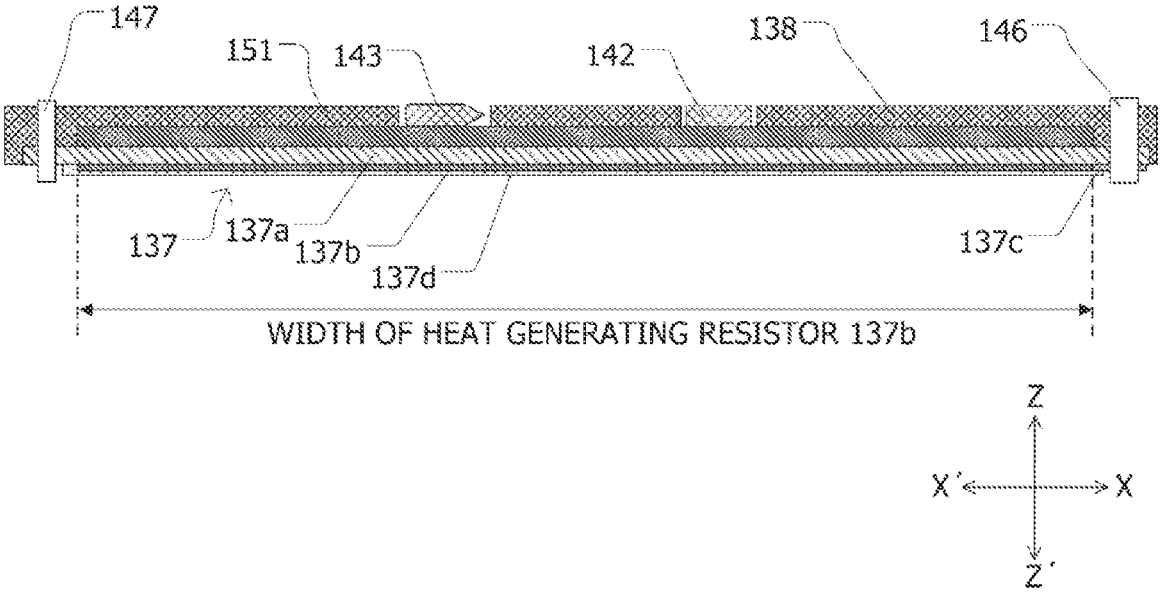
FIG. 6 is a cross-sectional view illustrating a film assembly according to Embodiment 1.
Figure 7A:
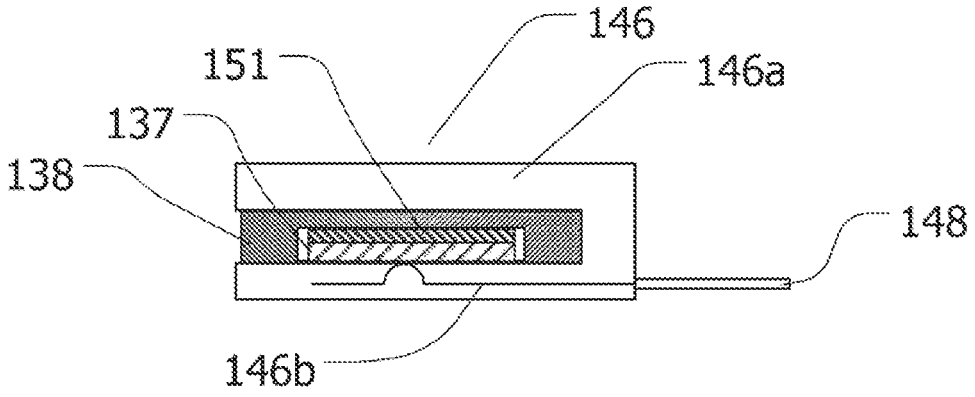
FIGS. 7A and 7B are explanatory drawings illustrating a power supply connector and a heater clip according to Embodiment 1.
Figure 7B:
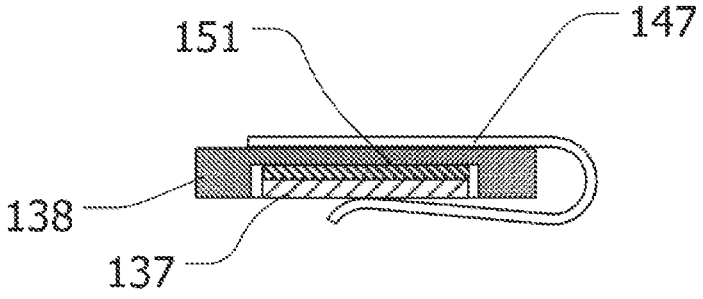

FIG. 6 is a cross-sectional view illustrating a part of the film assembly 131 in the longitudinal direction (the fixing film 136, the pressure stay 140, and the fixing flanges 141 are not illustrated). FIGS. 7A and 7B are explanatory drawings illustrating a power supply connector 146 and a heater clip 147 that serve as heater holding members.

As illustrated in FIG. 6, the heater 137 and the metal plate 151 placed on the heater 137 are provided in the heater holder 138. The ends of the heater 137 are held on the ends of the heater holder 138 by the power supply connector 146 and the heater clip 147 that serve as holding members. The thermistor 142 and the thermal fuse 143 are in contact with the backside of the metal plate 151 exposed from the through holes of the heater holder 138. The metal plate 151 acts as a plate for uniformly distributing heat. In the present embodiment, the metal plate 151 is a pure aluminum plate having a thickness of 0.3 mm. The metal plate 151 is 220 mm in length and 5.8 mm in width. The metal plate 151 has the same length as the heat generating resistor 137*b* of the heater 137 in the longitudinal direction, achieving the effect of obtaining a more uniform temperature of the heater 137.

As illustrated in FIG. 7A, the power supply connector 146 includes a resin housing portion 146*a* having a channel shape and a contact terminal 146*b*. The power supply connector 146 holds the heater 137, the heater holder 138, and the metal plate 151. The contact terminal 146*b* is in contact with the electrode 137*c* of the heater 137 while the heater 137 and the contact terminal 146*b* are electrically connected to each other. In the present embodiment, the power supply connector 146 is used as a heater holding member. The power supply connector 146 may be divided into a feeding member for feeding the heater 137 and a heater holding member. The contact terminal 146*b* is connected to a binding wire 148. The binding wire 148 is connected to an AC power supply or a triac, which is not illustrated.

As illustrated in FIG. 7B, the heater clip 147 includes a metal plate bended into a channel shape. The heater clip 147 has spring tension and presses the ends of the metal plate 151 and the heater 137 to the heater holder 138 so as to hold the metal plate 151 and the heater 137. The end of the heater 137 pressed by the heater clip 147 is movable in the sliding in-plane direction of the heater. This suppresses an unnecessary stress applied to the heater 137 by the thermal expansion of the heater 137. The heater holder 138, the metal plate 151, and the heater 137 are unfixed to one another in order to absorb deformation caused by a difference in thermal expansion or a pressing force and are kept in contact with one another by the spring tension of the heater clip 147, which serves as a holding member, and a pressing force by the pressure roller 132.

Figure 8A:
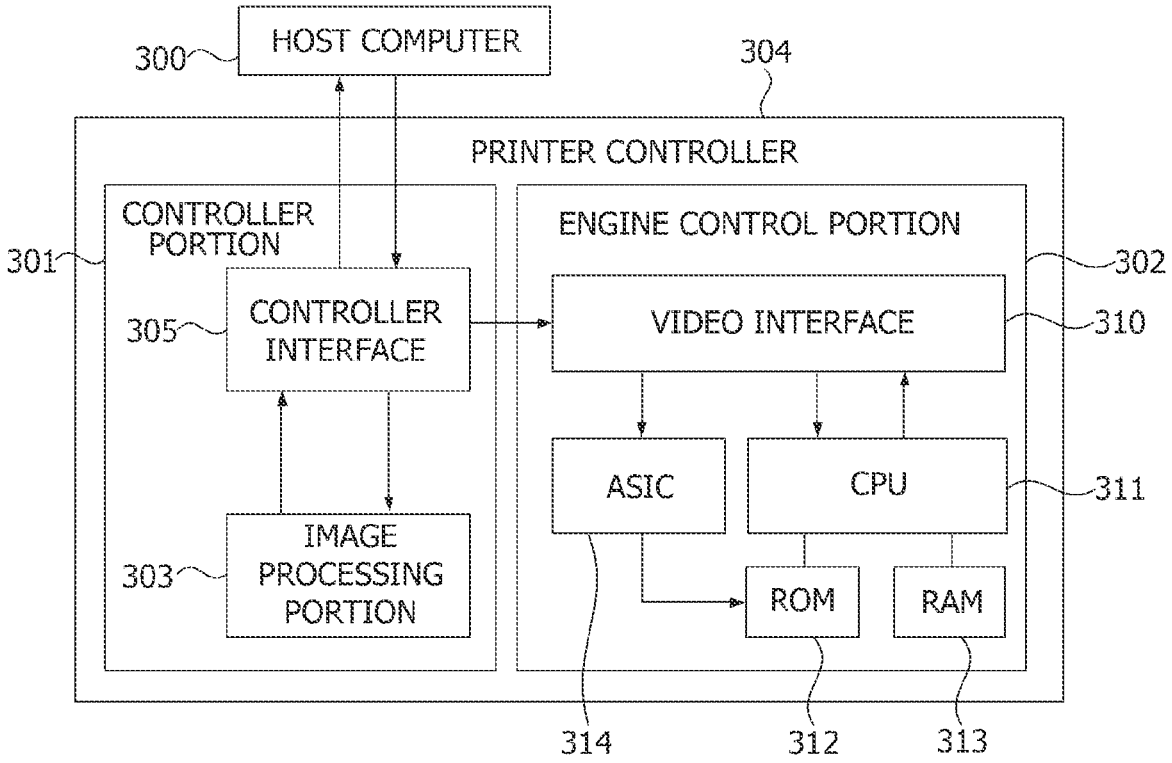
FIGS. 8A and 8B are block diagrams illustrating a printer system according to Embodiment 1.

Referring to FIG. 8A, a printer controller 304 according to the present embodiment will be described below. FIG. 8A is a block diagram illustrating a printer system (image forming system) according to the present embodiment. The printer controller 304 is assembled into the image forming apparatus that communicates with a host computer 300. The host computer 300 may be, for example, a server or a personal computer on networks such as the Internet and a local area network (LAN) or portable information terminals such as a smartphone and a tablet-type device. The printer controller 304 is connected to the host computer 300 and communicates with the host computer 300 by means of a controller interface 305.

The printer controller 304 is broadly divided into a controller portion 301 and an engine control portion 302. The controller portion 301 includes an image processing portion 303 and the controller interface 305. The image processing portion 303 bitmaps character codes and performs, for example, halftoning by dithering or the like on halftone images based on image information received from the host computer 300 via the controller interface 305. Moreover, the image processing portion 303 transmits the image information to a video interface 310 of the engine control portion 302 via the controller interface 305. The image information includes information for controlling the timing to turn on the laser scanners 24, a print mode for controlling process conditions such as a target temperature and a transfer bias, and image size information.

The controller portion 301 transmits the information on the timing to turn on the laser scanners 24, to an application specific integrated circuit (ASIC) 314. The ASIC 314 controls a part of the image forming portion, for example, the laser scanners 24. The information on a print mode and an image size is transmitted to a central processing unit (CPU) 311. The CPU 311 will be also referred to as a processor. The CPU 311 is not limited to a single processor and may have a multiprocessor configuration. The CPU 311 optionally stores information in RAM 313, uses programs stored in ROM 312 or the RAM 313, or refers to information stored in the ROM 312 or the RAM 313. The CPU 311 performs various types of control on the engine control portion 302 by using the ROM 312 or the RAM 313. Furthermore, the controller portion 301 transmit, for example, a print command and a cancellation instruction to the engine control portion 302 in response to a user instruction provided on a host computer, and controls an operation for starting or cancelling a printing operation.

Figure 8B:
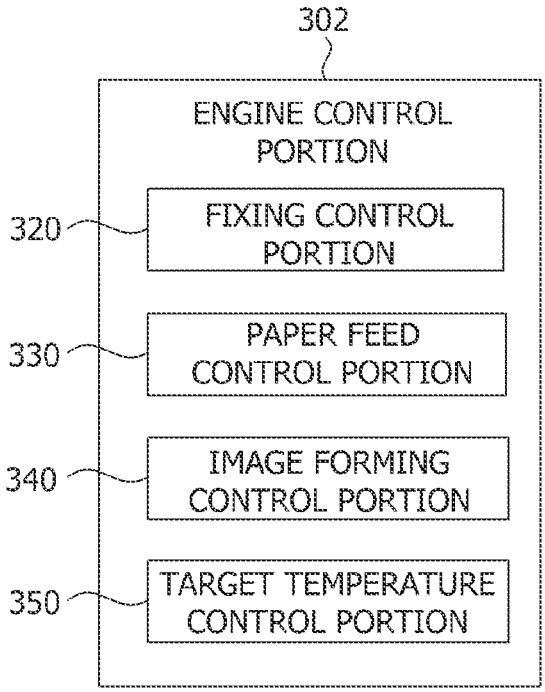

FIG. 8B illustrates an example of the functional configuration part of the engine control portion 302. As illustrated in FIG. 8B, the engine control portion 302 includes a fixing control portion 320, a paper feed control portion 330, an image-formation control portion 340, and a target temperature control portion 350. The CPU 311 performs various types of control on the engine control portion 302, enabling the engine control portion 302 to act as the portions illustrated in FIG. 8B. The fixing control portion 320 controls the fixing portion 50. The paper feed control portion 330 controls the intervals of operations of the paper feeding portion 20. The image forming control portion 340 performs, for example, process speed control, development control, charging control, and transfer control. Moreover, the image forming control portion 340 acquires operation information on the image forming apparatus, for example, a print command, a cancellation instruction, color-mode setting information, and monochrome-mode setting information from the host computer 300. The target temperature control portion 350 acting as a determination portion determines, changes, and sets a target temperature.

Processing performed by the image forming apparatus may be partially performed by the host computer 300 or a server on a network. Processing performed by the engine control portion 302 and the image processing portion 303 may be partially or entirely performed by the host computer 300 or a server on a network. The host computer 300 and the server on the network are examples of processors. Processing performed by the engine control portion 302 may be partially or entirely performed by the image processing portion 303, or processing performed by the image processing portion 303 may be partially or entirely performed by the engine control portion 302.

The engine control portion 302 includes a temperature control program. The fixing control portion 320 acting as a control portion controls the temperature of the heater 137 to a predetermined temperature based on a detected temperature of the thermistor 142 that acts as a temperature detecting portion or a temperature sensor.

The fixing control portion 320 controls a current passing through the heater 137 based on a detected temperature of the thermistor 142 such that the temperature of the heater 137 is kept at a desired temperature. In other words, the fixing control portion 320 controls the passage of a current to the heater 137 such that a detected temperature of the thermistor 142 is kept at a predetermined target temperature. For example, in response to the signal of the thermistor 142, the fixing control portion 320 controls a current passing through the heater 137, thereby controlling the temperature of the heater 137. Alternatively, the fixing control portion 320 may detect the temperature of the heater 137 as the temperature of the fixing portion 50. The fixing control portion 320 may control power to be supplied to the fixing portion 50 such that the temperature of the fixing portion 50 is kept at the target temperature. For example, in response to the signal of the thermistor 142, the fixing control portion 320 controls a current passing through the fixing portion 50, thereby controlling the temperature of the fixing portion 50. Processing performed by the fixing control portion 320 may be partially or entirely performed by the target temperature control portion 350.

The temperature of the heater 137 is preferably controlled by PID control that involves a proportional, an integrated term, and a derivative term. For example, the fixing control portion 320 determines a heater energization time in a period under PID control, drives a heater energization-time control circuit, which is not illustrated, and determines heater output power. In the present embodiment, the heater output power is updated at intervals of 100 msec in a control period.

The target temperature is set based on information from the image processing portion 303, which will be described later. The fixing control portion 320 may correct the target temperature according to correction information including the degree of heating of the fixing portion 50, an ambient temperature/humidity, a print mode, and the kind of the recording material 11 in addition to the information from the image processing portion 303.

Figure 9:
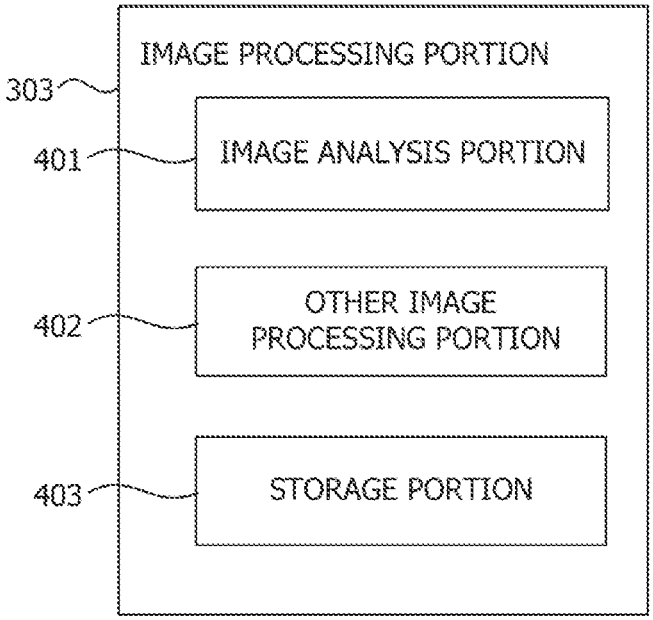
FIG. 9 illustrates an example of the functional configuration part of an image processing portion according to Embodiment 1.

FIG. 9 illustrates an example of the functional configuration part of the image processing portion 303. The image processing portion 303 includes an image analysis portion 401, and others, i.e., an image processing portion 402, and a storage portion 403. As will be described later, the image analysis portion 401 acting as an acquisition portion acquires an image end position that is the position of one end of the toner image t in a main scanning direction perpendicular to the conveying direction of the recording material 11. The other image processing portion 402 performs image transformation for character codes or halftoning and bitmaps an image. The storage portion 403 stores data and information that are generated in processing performed by the image analysis portion 401 and the other image processing portion 402. The storage portion 403 is, for example, RAM.

In the image forming apparatus according to the present embodiment, processing is performed by the other image processing portion 402 with a 600-dpi resolution. The processing may be performed by the other image processing portion 402 with other resolutions. Moreover, the image analysis portion 401 performs a computation on image information (image data) after the completion of the processing by the other image processing portion 402. The order of image processing is not limited. The computation may be performed on the image information before the processing is performed by the other image processing portion 402.

The heater 137 of the fixing portion 50 uniformly generates heat in the main scanning direction (the longitudinal direction of the heater 137). Although uniform heat applied to the recording material 11 is preferable, uniform heat is not easily applied to all the recording materials 11 of different sizes. For example, if the recording material 11 has a large width in the main scanning direction, the amount of heat applied to one end of the recording material 11 is likely to be smaller than that of the central portion of the recording material 11, so that a temperature on the end of the recording material 11 is lower than that of the central portion. This phenomenon will be referred to as "end temperature decrease" in the present embodiment. This is because heat escapes from the ends of the recording material 11 through various components such as the cored bar 132*a* of the pressure roller 132 and the fixing flanges 141 as illustrated in FIG. 3.

If the recording material 11 has a small width in the main scanning direction, heat applied to the ends of the fixing nip portion N in the main scanning direction is accumulated in members including the heater 137, the fixing film 136, and the pressure roller 132 without being absorbed by the recording material 11. This may cause a high temperature on the ends of the fixing nip portion N in the main scanning direction. This phenomenon is referred to as "end temperature rise (end temperature increase)" in the present embodiment. In order to suppress "end temperature rise." the heater 137 is provided with the metal plate 151 for uniformly distributing heat from the heater 137. However, the amount of heat transport of the metal plate 151 is limited, resulting in insufficiently uniform heat distribution from the heater 137. If the metal plate 151 has a larger cross-sectional area, the amount of heat transport of the metal plate 151 can be increased to enhance the heat equalization effect. However, the metal plate 151 having a larger heat capacity may extend a time before the temperature of the heater 137 reaches a fixing temperature.

As described above, "end temperature decrease" and "end temperature rise" are mutually contradictory phenomena with respect to the width of the recording material 11. In some image forming apparatuses, in order to suppress "end temperature decrease," the heat generating resistors 137*b* are formed such that the amount of heat from the heater 137 is increased on the ends of the fixing nip portion N in the main scanning direction. Unfortunately, "end temperature rise" may decrease accordingly. In the heater configuration of a comparative example in FIG. 14A, the heat generating resistor 137*b* of the heater 137 is divided into multiple resistors in the longitudinal direction of the heater 137. In the heater configuration of a comparative example in FIG. 14B, at least two heat generating resistors 137*b* having different heat distributions in the longitudinal direction of the heater 137 are provided. In the heater configurations of the comparative examples in FIGS. 14A and 14B, the heat distribution of the heater 137 in the longitudinal direction is variable according to the width of the used recording material 11, thereby suppressing both of "end temperature decrease" and "end temperature rise". However, the heater configurations of the comparative examples in FIGS. 14A and 14B may increase the cost of the image forming apparatus.

Hence, in the present embodiment, the image forming apparatus includes the fixing portion 50 provided with the heater 137 having a single heat distribution in the main scanning direction. In the image forming apparatus configured thus, the target temperature control portion 350 selects a proper target temperature according to the foregoing "end temperature decrease" based on the image end position, thereby determining a lower target temperature than a target temperature set regardless of "end temperature decrease".

Figure 10A:
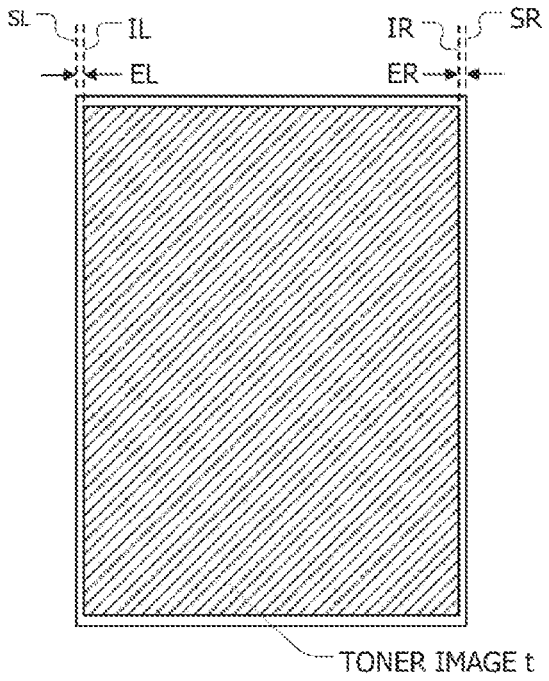
FIGS. 10A to 10C are explanatory drawings illustrating image examples according to Embodiment 1.
Figure 10B:
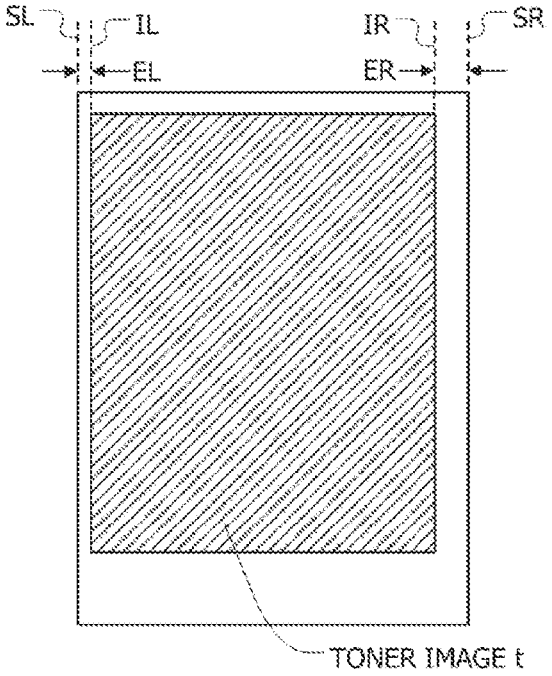
Figure 10C:
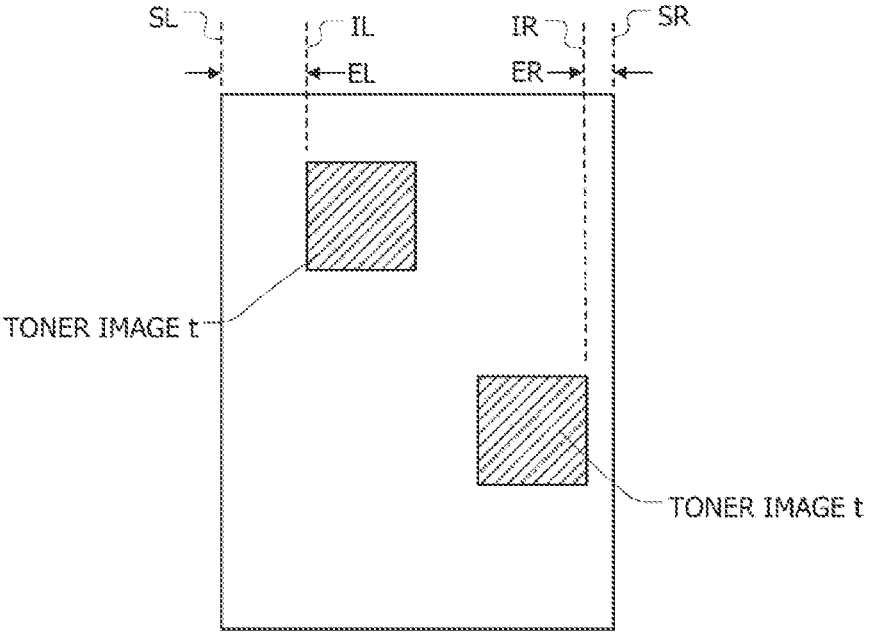

Referring to FIGS. 10A to 10C, a method for acquiring an image end position in the image analysis portion 401 will be described below. The recording material 11 having a maximum size (the maximum size of fixation by the fixing portion 50) usable in the image forming apparatus of the present embodiment is 216 mm in width while the width of each margin of the recording material 11 in the main scanning direction (lateral direction) has a minimum value of 2 mm. Thus, the toner image t having a maximum size of image formation on the recording material 11 is 212 mm in width (maximum width). With respect to the left and right ends of the recording material 11 having a maximum width of 216 mm, the left-end position of the recording material 11 (the position of one end of the recording material 11 in the main scanning direction) is defined as a position SL while the right-end position of the recording material 11 (the position of the other end of the recording material 11 in the main scanning direction) is defined as a position SR. The left-end position of the toner image t formed on the recording material 11 (the position of one end of the toner image t in the main scanning direction) is defined as a position IL while the right-end position of the toner image t formed on the recording material 11 (the position of the other end of the toner image t in the main scanning direction) is defined as a position IR. If multiple toner images t are formed on the recording material 11, the left end position closest to the position SL is selected as the position IL from among the left end positions of the toner images t while the right end position closest to the position SR is selected as the position IR from among the right end positions of the toner images t. A distance between the position SL and the position IL is defined as an image left-end distance EL while a distance between the position SR and the position SL is defined as an image right-end distance ER. A smaller one (value) of the image left-end distance EL and the image right-end distance ER is defined as a minimum image-end distance Emin.

FIGS. 10A to 10C illustrate examples of the toner image t (image) formed on the recording material 11. In the examples of FIGS. 10A to 10C, each margin of the recording material 11 is 2 mm in width in the main scanning direction. In the example of FIG. 10A, the image left-end distance EL=the image right-end distance ER=2 mm and the minimum image-end distance Emin=2 mm are determined. In the example of FIG. 10B, the image left-end distance EL=5 mm, the image right-end distance ER=20 mm, and the minimum image-end distance Emin=5 mm are determined. In the example of FIG. 10C, the image left-end distance EL=50 mm, the image right-end distance ER=15 mm, and the minimum image-end distance Emin=15 mm are determined.

Figure 11A:
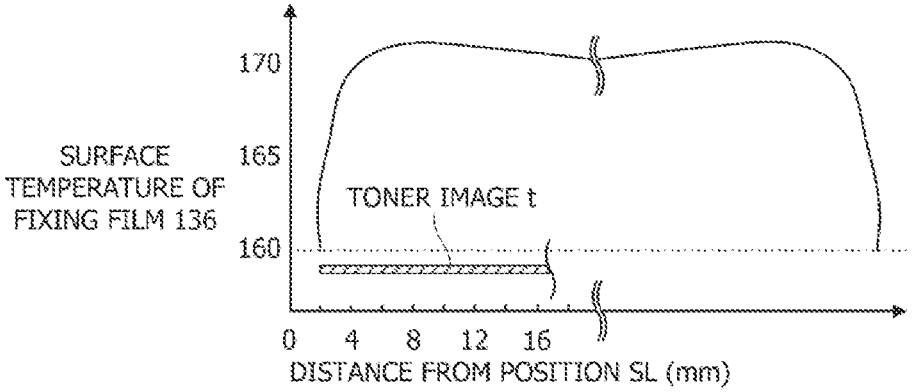
FIGS. 11A to 11C are explanatory drawings indicating the effect of Embodiment 1.
Figure 11B:
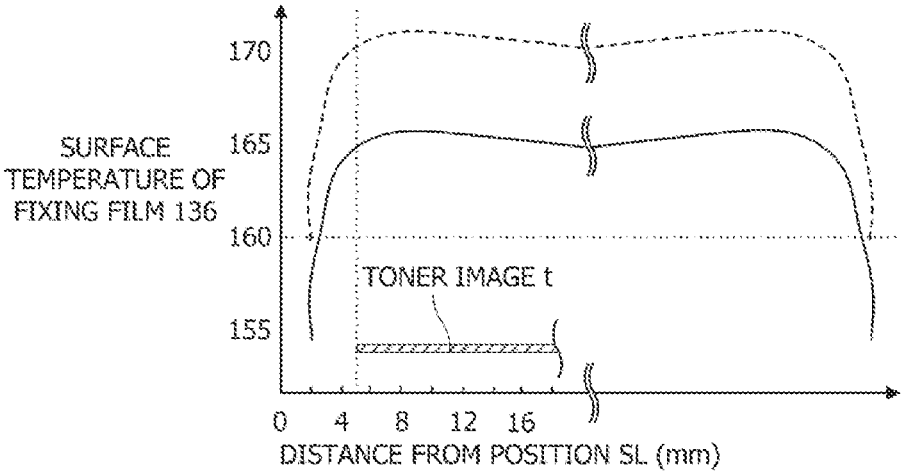
Figure 11C:
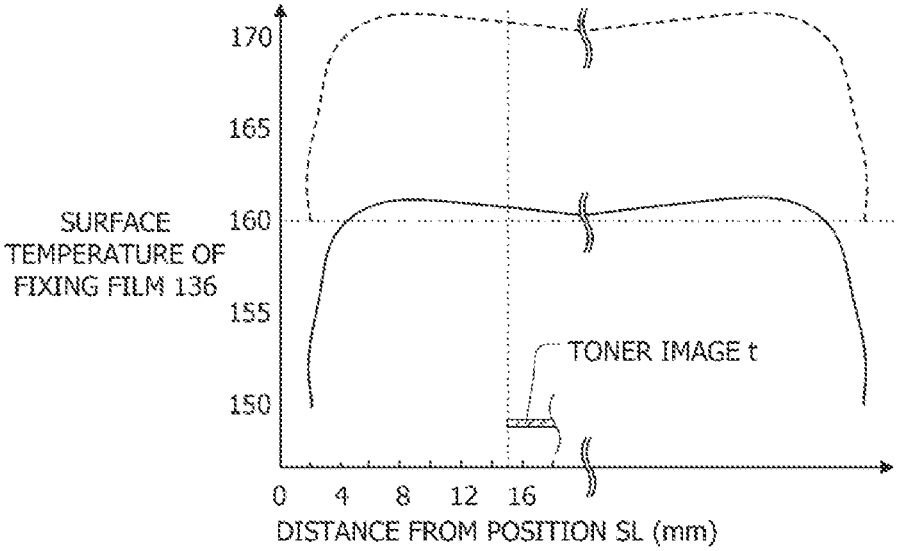

Referring to FIGS. 11A to 11C, a method for determining a target temperature by using "end temperature decrease" and image end-position information according to the present embodiment will be described below. FIG. 11A indicates the distribution of surface temperatures on the fixing film 136 in the main scanning direction immediately before the toner image t on the recording material 11 is fixed, the recording material 11 having a width of 216 mm that is a maximum usable size. It is understood that whether the toner image t on the recording material 11 can be fixed mainly depends upon the surface temperature of the fixing film 136. In the present embodiment, the fixing of the toner image t requires a surface temperature of 160° C. on the fixing film 136.

As indicated in FIG. 11A, in the main scanning direction, the ends of the fixing film 136 have a lower surface temperature than the central portion of the fixing film 136

(end temperature decrease) with a temperature difference of 10° C. In the following description, the same degree (level) of end temperature decrease is determined on the left end and the right end of the recording material 11. In this state, as indicated in FIG. 11A, the fixing of the image in FIG. 10A requires the setting of a target temperature such that the minimum image-end distance Emin=up to 2 mm and the fixing film 136 has a surface temperature of at least 160° C. In this case, the target temperature is denoted as Tt.

The fixing film 136 may have a surface temperature of not more than 160° C. so as to correspond to a margin region having no toner images t on the recording material 11. Thus, in the case of a large minimum image-end distance Emin, that is, a large margin region on each of the left and right ends of the recording material 11, the target temperature can be reduced. In the present embodiment, the relationship between the minimum image-end distance Emin and a target temperature is set as indicated in Table 1.

TABLE 1

| Minimum image-end distance Emin (mm) | Target temperature (° C.) |
|---|---|
| Emin ≤ 4 | Tt |
| 4 < Emin ≤ 12 | Tt-5 |
| 12 < Emin | Tt-10 |

As indicated in FIG. 11B, the image in FIG. 10B can be fixed if the minimum image-end distance Emin=5 mm is determined and the fixing film 136 has a surface temperature of at least 160° C. in a range corresponding to the toner image t on the recording material 11. As indicated in Table 1, in the case of the minimum image-end distance Emin=5 mm, the target temperature is set at Tt−5° C. A solid line in FIG. 11B indicates a surface temperature of the fixing film 136 when the target temperature is set at Tt−5° C. A dotted line in FIG. 11B indicates a surface temperature of the fixing film 136 when the target temperature is set at Tt° C.

As indicated in FIG. 11C, the image in FIG. 10C can be fixed if the minimum image-end distance Emin=15 mm is determined and the fixing film 136 has a surface temperature of at least 160° C. in a range corresponding to the toner image t on the recording material 11. As indicated in Table 1, in the case of the minimum image-end distance Emin=15 mm, the target temperature is set at Tt−10° C. A solid line in FIG. 11C indicates a surface temperature of the fixing film 136 when the target temperature is set at Tt−10° C. A dotted line in FIG. 11C indicates a surface temperature of the fixing film 136 when the target temperature is set at Tt° C.

As described above, in the present embodiment, power consumption can be reduced by determining a target temperature based on the image end-position information in consideration of "end temperature decrease". As indicated in FIGS. 11A to 11C, an excessive amount of heat to the heater 137 is suppressed by setting a lower target temperature as the minimum image-end distance Emin increases. This can reduce power consumption.

In the example of the present embodiment, a target temperature is determined by calculating the minimum image-end distance Emin based on an image end position with respect to the left and right ends of the recording material 11 having the maximum width. The present invention is not limited to this example. A target temperature may be determined by calculating another parameter by using an image end position. Moreover, in the present embodiment, the same degree of "end temperature decrease" is determined on the left end and the right end of the recording material 11. The left end and the right end of the recording material 11 may have different degrees of "end temperature decrease". In this case, a target temperature may be determined based on each of the image left-end distance EL and the image right-end distance ER. In the present embodiment, the recording material 11 has a maximum size (216 mm in width) usable for the image forming apparatus. The present embodiment may be applied to a recording material 11 smaller than the maximum size. As described above, in the present embodiment, a target temperature is determined based on an image end position. This can select a more proper target temperature, leading to lower power consumption.

An example of processing performed by the image analysis portion 401 and the target temperature control portion 350 according to the present embodiment will be described below. Processing performed by the image analysis portion 401 may be partially or entirely performed by the target temperature control portion 350, or processing performed by the target temperature control portion 350 may be partially or entirely performed by the image analysis portion 401. If an image end position is located at the same position as one end of the toner image t in the main scanning direction, the toner image t having a maximum size (maximum width) of image formation on the recording material 11, the target temperature control portion 350 determines a first target temperature as a target temperature. In other words, in the case of the minimum image-end distance Emin=0 mm, the target temperature control portion 350 determines a first target temperature (Tt) as a target temperature.

If an image end position is located between one end of the toner image t and the center of the recording material 11 in the main scanning direction, the toner image t having a maximum size (maximum width) of image formation on the recording material 11, the target temperature control portion 350 determines a second target temperature as a target temperature. For example, in the case of the minimum image-end distance Emin=10 mm, the target temperature control portion 350 determines a second target temperature (Tt−5° C.), which is lower than the first target temperature (Tt), as a target temperature. For example, in the case of the minimum image-end distance Emin=15 mm, the target temperature control portion 350 determines a second target temperature (Tt−10° C.), which is lower than the first target temperature (Tt), as a target temperature. In this way, a temperature difference between the first target temperature and the second target temperature increases with the minimum image-end distance Emin.

The target temperature control portion 350 reduces a target temperature as the minimum image-end distance Emin increases, achieving lower power consumption. The relationship between the minimum image-end distance Emin and the target temperature is not limited to the setting of Table 1. Other settings may be used instead. For example, the target temperature may be set at Tt° C. for the minimum image-end distance Emin=0 mm, the target temperature may be set at Tt−5° C. for 0 mm<the minimum image-end distance Emin≤12 mm, and the target temperature may be set at Tt−10° C. for 12 mm<the minimum image-end distance Emin.

The target temperature control portion 350 determines a target temperature based on shorter one of a first distance from the position of one end of the recording material 11 to the image end position in the main scanning direction and a second distance from the position of the other end of the recording material 11 to the image end position in the main scanning direction. In FIGS. 11A to 11C, the position of one end of the recording material 11 in the main scanning direction is denoted as the position SL while the position of the other end of the recording material 11 in the main scanning direction is denoted as the position SR. In FIG. 11A, the first distance (image left-end distance EL) from the position SL to the image end position (position IL) and the second distance (image right-end distance ER) from the position SR to the image end position (position IR) are equal to each other. In this case, the target temperature control portion 350 determines a target temperature based on the first distance (image left-end distance EL) or the second distance (image right-end distance ER).

In FIG. 11B, the first distance (image left-end distance EL) from the position SL to the image end position (position IL) is shorter than the second distance (image right-end distance ER) from the position SR to the image end position (position IR). In this case, the target temperature control portion 350 determines a target temperature based on shorter one (image left-end distance EL) of the first distance (image left-end distance EL) and the second distance (image right-end distance ER). In FIG. 11C, the second distance (image right-end distance ER) from the position SR to the image end position (position IR) is shorter than the first distance (image left-end distance EL) from the position SL to the image end position (position IL). In this case, the target temperature control portion 350 determines a target temperature based on shorter one (image right-end distance ER) of the first distance (image left-end distance EL) and the second distance (image right-end distance ER).

Embodiment 2

Figure 12:
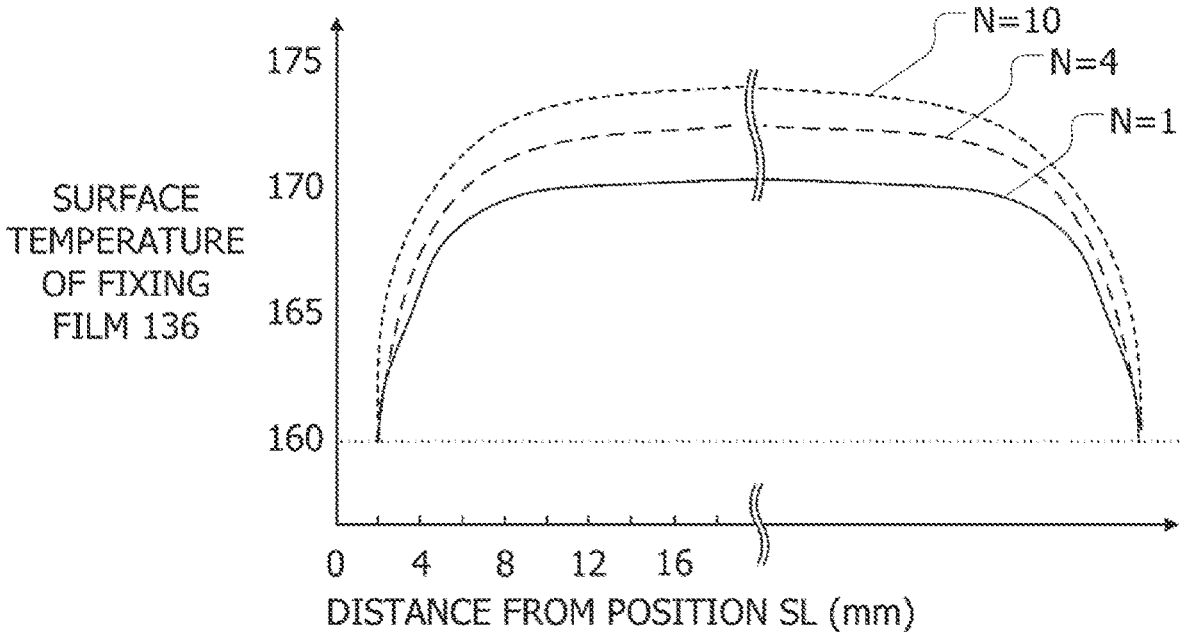
FIG. 12 is an explanatory drawing indicating the effect of Embodiment 2.

Referring to FIG. 12, Embodiment 2 will be described below. The present embodiment is different from Embodiment 1 in that a target temperature is determined by using the number of consecutively treated sheets of the recording material 11 in addition to image end-position information. Most of the configurations and operations of an image forming apparatus according to the present embodiment are identical to those of Embodiment 1, and thus only differences from Embodiment 1 will be described below. The same configurations as those of Embodiment 1 are indicated by the same reference numerals, and an explanation thereof is omitted.

The state of "end temperature decrease" in Embodiment 1 may be changed by consecutive image forming operations. In the image forming apparatus of the present embodiment, "end temperature decrease" develops with consecutive image forming operations, depending upon the configuration of the image forming apparatus. This is because heat dissipation continues on the ends of a fixing nip portion N in the main scanning direction while heat is gradually stored in members at the central portion of the fixing nip portion N in the main scanning direction. The image forming apparatus can be configured to suppress "end temperature decrease" with consecutive image forming operations. In this case, the above-mentioned "end temperature rise" may decrease.

FIG. 12 indicates the progression of a temperature distribution of surface temperatures on a fixing film 136 in the longitudinal direction (main scanning direction) according to the number of consecutively treated sheets of the recording material 11 in the present embodiment. The number of consecutively treated sheets of the recording material 11 is, for example, the number of sheets of the recording material 11 consecutively conveyed by the fixing nip portion N. An image analysis portion 401 acquires the number of consecutively treated sheets of the recording material 11 by counting the number of consecutively treated sheets of the recording material 11. In the case where fixing is performed on the preceding recording material 11 conveyed by the fixing nip portion N and the subsequent recording material 11 is conveyed by the fixing nip portion N in a predetermined time, the image analysis portion 401 adds 1 to the number of consecutively treated sheets of the recording material 11 (N). Alternatively, a counter portion provided in the image forming apparatus may count the number of consecutively treated sheets of the recording material 11, and then the image analysis portion 401 may acquire the number of consecutively treated sheets of the recording material 11 from the counter portion.

FIG. 12 indicates, as in FIG. 11A of Embodiment 1, the longitudinal distribution of surface temperatures on the fixing film 136 at a target temperature Tt that meets at least 160° C. where fixing to the ends (Emin=2 mm) can be performed. As indicated in FIG. 12, regarding N=4 and N=10 where N is the number of consecutively treated sheets of the recording material 11, a temperature difference increases between a surface temperature at the central portion and a surface temperature on the ends of the fixing film 136 in the longitudinal direction. Thus, in the present embodiment, a reduction in target temperature relative to a minimum image-end distance Emin vanes according to the number of consecutively treated sheets of the recording material 11. Table 2 indicates the relationship among the minimum image-end distance Emin, the consecutively treated sheets number N of the recording material N, and a target temperature.

TABLE 2

| Minimum image-end distance Emin (mm) | N ≤ 3 | 4 ≤ N ≤ 9 | 10 ≤ N |
|---|---|---|---|
| Emin ≤ 4 | Tt | Tt | Tt |
| 4 ≤ Emin ≤ 12 | Tt-5 | Tt-6 | Tt-7 |
| 12 ≤ Emin | Tt-10 | Tt-12 | Tt-14 |

A target temperature control portion 350 determines a target temperature based on an image end position and the number of consecutively treated sheets of the recording material 11. In the present embodiment, a reduction in target temperature is increased with "end temperature decrease" according to the number of consecutively treated sheets of the recording material 11. The target temperature control portion 350 reduces the target temperature as the number of consecutively treated sheets of the recording material 11 increases. This achieves lower power consumption than in Embodiment 1 in the formation of consecutive images on sheets of the recording material 11.

In the example of the present embodiment, "end temperature decrease" is increased as images are consecutively formed. The present embodiment may be applied to a configuration where "end temperature decrease" is reduced. In this case, a reduction in target temperature is reduced as the number of consecutively treated sheets of the recording material 11 increases. The target temperature control portion 350 may raise the target temperature as the number of consecutively treated sheets of the recording material 11 increases.

As described above, in the present embodiment, a target temperature is determined based on the number of consecutively treated sheets of the recording material 11 in addition to the image end-position information. This enables fixing on the recording material 11 at a lower target temperature, leading to lower power consumption.

Embodiment 3

Figure 13:
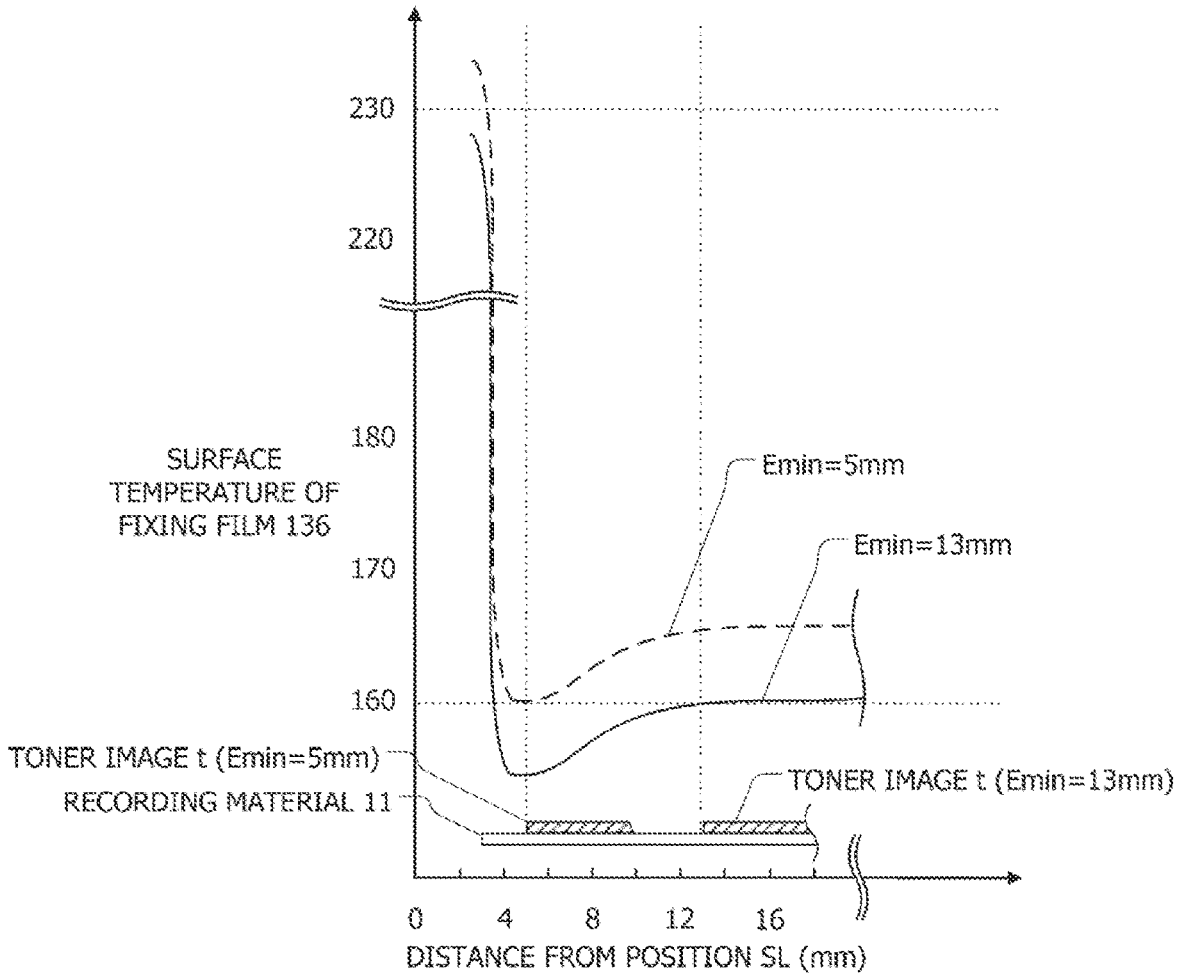
FIG. 13 is an explanatory drawing indicating the effect of Embodiment 3.
Figure 14A:
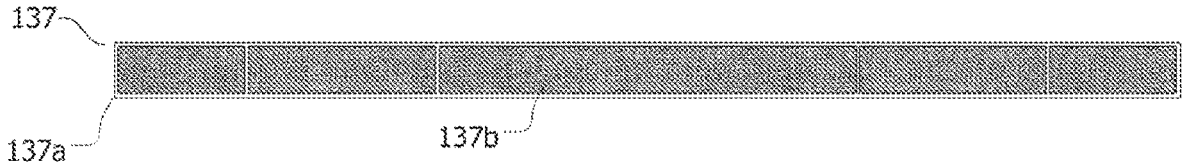
FIGS. 14A and 14B are explanatory drawings illustrating a heater according to a comparative example.
Figure 14B:
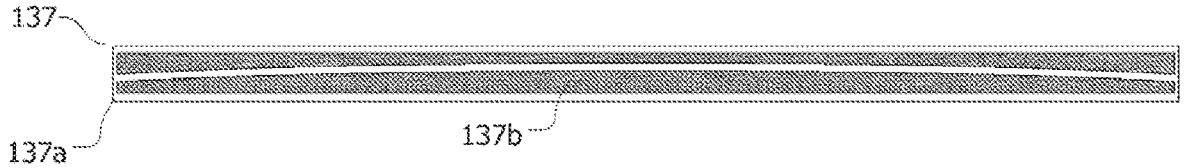

Referring to FIG. 13, Embodiment 3 will be described below. The present embodiment is different from Embodiment 1 and Embodiment 2 in that a target temperature is determined based on image end-position information and the productivity of image formation is changed. Most of the configurations and operations of an image forming apparatus according to the present embodiment are identical to those of Embodiment 1 and Embodiment 2, and thus only differences from Embodiment 1 and Embodiment 2 will be described below. The same configurations as those of Embodiment 1 and Embodiment 2 are indicated by the same reference numerals, and an explanation thereof is omitted.

Embodiment 1 and Embodiment 2 describe the recording material 11 having a width of 216 mm that is a maximum size usable for the image forming apparatus. In the present embodiment, a recording material 11 has a width of 210 mm that is smaller than the maximum size usable for the image forming apparatus.

As described above, if the recording material 11 has a small width in the main scanning direction, a phenomenon called "end temperature rise" occurs, in which heat applied to the ends of a fixing nip portion N is accumulated in members including a heater 137, a fixing film 136, and a pressure roller 132 without being absorbed by the recording material 11. The operating temperatures of the members have upper limits. If the members are used above the operating temperatures, the members may be damaged. Thus, the members are to be used at not more than a given temperature. "End temperature rise" develops with consecutive image forming operations, which requires some measures, for example, the conveyance of sheets of the recording material 11 at larger intervals with lower productivity such that the members are kept at not more than the given temperature.

In consecutive image forming operations using the recording material 11 having a small width in the main scanning direction, "end temperature rise" develops outside the recording material 11 (will be referred to as a sheet non-passing portion) in the main scanning direction, whereas "end temperature decrease" occurs inside the recording material 11 (will be referred to as a sheet passing portion) in the main scanning direction. The frequencies of "end temperature rise" and "end temperature decrease" vary depending upon the heat distribution of the heater 137 and the heat capacities and heat conductivities of the members.

FIG. 13 indicates the temperature distribution of surface temperatures on the fixing film 136 in the longitudinal direction (main scanning direction) when the recording material 11 having a width of 210 mm is used. In the image forming apparatus of the present embodiment, the recording material 11 is conveyed relative to the center of a feed path. Thus, the left end of the recording material 11 is located at 3 mm from a left end SL of a maximum width of 216 mm of the recording material 11, whereas the right end of the recording material 11 is located at 3 mm from a right end SR of the maximum width of 216 mm of the recording material 11. If the width of the recording material 11 is smaller than a maximum size usable for the image forming apparatus, heat applied outside the recording material 11 in the main scanning direction is accumulated in the members in consecutive image forming operations. The surface temperature of the fixing film 136 finally rises to a temperature at which the surface temperature is balanced with heat dissipation.

FIG. 13 indicates a temperature distribution of the fixing film 136 while a temperature is balanced with heat dissipation by consecutive image forming operations. As described above, the operating temperatures of the members have upper limits. In the present embodiment, the upper limit of a surface temperature on the fixing film 136 is 230° C. If an image having a maximum size of image formation is formed on the recording material 11 having a width of 210 mm, a minimum image-end distance Emin=5 mm (a 2-mm margin on each of the left and right ends of the recording material 11) is determined. As indicated in FIG. 13, a target temperature is to be set such that the fixing film 136 has a surface temperature of at least 160° C. at 5 mm from the left end SL. However, if images are consecutively formed at this target temperature, the surface temperature of the fixing film 136 exceeds 230° C., the upper limit, on the ends of the fixing film 136 in the main scanning direction. Thus, the productivity of image formation is to be reduced by conveying sheets of the recording material 11 at larger intervals.

The conveyance of sheets of the recording material 11 at larger intervals reduces the amount of heat applied per unit time, thereby suppressing the surface temperature of the fixing film 136 to not more than 230° C. In image formation at a maximum speed of conveyance, 25 pieces of the recording material 11 are conveyed per minute. If images are consecutively formed on the recording material 11 having a width of 210 mm, 25 sheets of the recording material 11 are conveyed per minute in the image formation of N consecutively treated sheets ≤20, whereas 20 sheets of the recording material 11 are conveyed per minute in the image formation of N consecutively treated sheets ≥21. In this way, the productivity of image formation is reduced.

As described above, in the image formation of N consecutively treated sheets ≥21, the productivity of image formation is reduced by conveying 20 sheets of the recording material 11 per minute. The present invention is not limited to this treatment. If a toner image t having a maximum size of formation is formed on the recording material 11 having a width of 210 mm, the productivity of image formation may be reduced by conveying 20 sheets of the recording material 11 per minute regardless of N consecutively treated sheets.

In the case of the minimum image-end distance Emin=13 mm (a 10-mm margin on the recording material 11), the fixing film 136 may have a surface temperature of at least 160° C. in a range corresponding to the toner image t on the recording material 11. Thus, the target temperature can be reduced by 7° C. as indicated in Table 2 of Embodiment 2. Hence, even if images are consecutively formed on the condition that 25 pieces of the recording material 11 are conveyed per minute at the maximum speed of conveyance, the surface temperature of the fixing film 136 does not reach 230° C., the upper limit temperature, on the ends of the fixing film 136 in the longitudinal direction. This can continuously form images without reducing the productivity of image formation. If image end-position information is not used, a target temperature is to be determined on the assumption that the toner image t having the maximum size of formation is always formed on the recording material 11. Thus, in the case of the minimum image-end distance Emin=13 mm in the absence of the image end-position information, the productivity of image formation is to be reduced as in the case of the minimum image-end distance Emin=5 mm.

An example of processing performed by the image analysis portion 401 and the target temperature control portion 350 according to the present embodiment will be described below. Processing performed by the image analysis portion 401 may be partially or entirely performed by the target temperature control portion 350, or processing performed by the target temperature control portion 350 may be partially or entirely performed by the image analysis portion 401.

In the present embodiment, a first recording material is the recording material 11 having a maximum size (216 mm in width) of fixation by the fixing portion 50 in the main scanning direction while a second recording material is the recording material 11 having a smaller size (210 mm in width) than the first recording material in the main scanning direction. If an image end position is located at the same position as one end of the toner image t in the main scanning direction, the toner image t having a maximum size (maximum width) of image formation on the second recording material, the target temperature control portion 350 determines, as a first interval, an interval of conveyance for pieces of the second recording material. For example, if the minimum image-end distance Emin is 5 mm when the toner image t is formed on the second recording material, the target temperature control portion 350 determines, as a first interval, an interval of conveyance for pieces of the second recording material. If an image end position is located between one end of the toner image t and the center of the recording material 11 in the main scanning direction, the toner image t having a maximum size (maximum width) of formation on the second recording material, the target temperature control portion 350 determines, as a second interval, an interval of conveyance for pieces of the second recording material. The second interval is shorter than the first interval. For example, if the minimum image-end distance Emin is 13 mm when the toner image t is formed on the second recording material, the target temperature control portion 350 determines, as a second interval, an interval of conveyance for pieces of the second recording material.

If the recording material 11 has a smaller width than the maximum width usable for the image forming apparatus and the image end position is located inside one end of an image having a maximum size of image formation on the recording material 11, the image formation can be more productive than the formation of an image having the maximum size. In the example of the present embodiment, the recording material 11 having a smaller width than the maximum width usable for the image forming apparatus has a width of 210 mm. The present embodiment is also applicable to the recording material 11 having a different width from 210 mm.

Embodiments 1 to 3 were described according to the configuration of the color image forming apparatus. The configuration of a monochrome image forming apparatus may be used instead. The heating configuration using a ceramic heater was described. A configuration according to a different heating method, for example, a halogen heater or induction heating (IH) may be used instead. The configuration for printing with the host computer 300 connected to the image forming apparatus was described. For printing, the host computer 300 connected to the image forming apparatus may be replaced with a computer or a print server that is connected on a network. The image processing portion 303 calculates a correction of image analysis and a target temperature. The present invention is not limited to this configuration. The calculation of a correction of image analysis and a target temperature may be partially or entirely performed by the host computer 300 and programs in a printer and a print server on a network.

The target temperature may be changed based on fixing-mode information, surrounding environment information detected by environment detecting means, which is not illustrated, and type information on the recording material 11 detected by a medium sensor, which is not illustrated. In the fixing control, a target temperature is set or changed. A gain or offset electric energy of PID control used for target temperature control may be changed. Moreover, in the embodiments, a correction value may be calculated relative to a reference target temperature, and then a target temperature may be set by correcting the reference target temperature according to the correction value. The correction value may be replaced with a value correlated with the target temperature, or another value correlated with fixing performance.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions. This application claims the benefit of Japanese Patent Application No. 2020-096185, filed on Jun. 2, 2020, which is hereby incorporated by reference herein in its entirety.

What is claimed is:

1. An image forming apparatus, comprising:

an image forming portion configured to form a toner image on a recording material according to image information on a predetermined image;

a fixing portion configured to fix the toner image on the recording material by heating the recording material having thereon the toner image while conveying the recording material by a nip portion;

at least one processor; and at least one memory, the at least one memory storing instructions that, when executed by the at least one processor, cause the at least one processor to function as an acquisition portion that acquires an image end position that is a position of one end of the toner image in a main scanning direction perpendicular to a conveying direction of the recording material;

a determination portion that determines a target temperature based on the image end position; and a control portion that controls the fixing portion based on the target temperature, wherein the determination portion determines the target temperature based on a shorter one of (i) a first distance from a position of a first end of the recording material to the image end position in the main scanning direction and (ii) a second distance from a position of a second end of the recording material to the image end position in the main scanning direction.

2. The image forming apparatus according to claim 1, wherein the acquisition portion acquires the number of consecutive sheets of the recording material conveyed by the nip portion, and the determination portion determines the target temperature based on the image end position and the number of consecutive sheets.

3. The image forming apparatus according to claim 2, wherein the determination portion reduces the target temperature as the number of consecutive sheets increases.

4. The image forming apparatus according to claim 1, wherein the determination portion determines, as the target temperature, a first target temperature when the image end position is located at a position same as one end of a predetermined toner image in the main scanning direction, the predetermined toner image having a maximum size formable on the recording material, and the determination portion determines, as the target temperature, a second target temperature lower than the first target temperature when the image end position is located further toward a center side of the recording material in the main scanning direction than a position of the one end of the predetermined toner image, the predetermined toner image having the maximum size formable on the recording material.

5. The image forming apparatus according to claim 4, wherein a temperature difference between the first target temperature and the second target temperature increases as a distance to the image end position from the position of the one end of the predetermined toner image having the maximum size formable on the recording material increases.

6. The image forming apparatus according to claim 1, wherein the recording material is one of a plurality of recording materials, and the plurality of recording materials include a first recording material having a maximum size of fixation by the fixing portion in the main scanning direction and a second recording material having a smaller size than the maximum size in the main scanning direction, the determination portion determines, as a first interval, a conveying interval between sheets of the second recording material when the image end position is located at a position same as one end of a predetermined toner image in the main scanning direction, the predetermined toner image having a maximum size formable on the second recording material, and the determination portion determines, as a second interval shorter than the first interval, a conveying interval between sheets of the second recording material when the image end position is located further toward a center side of the second recording material in the main scanning direction than the one end of the predetermined toner image, the predetermined toner image having the maximum size formable on the second recording material.

7. The image forming apparatus according to claim 1, wherein the fixing portion includes a heater unit provided with a heater for heating the recording material, and the heater has a single heat distribution in the main scanning direction.

8. The image forming apparatus according to claim 7, wherein the fixing portion includes a tubular film in contact with the recording material, and the heater unit is in contact with an inner surface of the film.

9. The image forming apparatus according to claim 8, wherein the fixing portion includes a roller that forms the nip portion together with the heater, with the film being interposed between the roller and the heater.

10. An image forming apparatus, comprising:

an image forming portion configured to form a toner image on a recording material according to image information on a predetermined image;

a fixing portion configured to fix the toner image on the recording material by heating the recording material having thereon the toner image while conveying the recording material by a nip portion;

at least one processor; and at least one memory, the at least one memory storing instructions that, when executed by the at least one processor, cause the at least one processor to function as an acquisition portion that acquires an image end position that is a position of one end of the toner image in a main scanning direction perpendicular to a conveying direction of the recording material;

a determination portion that determines a target temperature based on the image end position; and a control portion that controls the fixing portion based on the target temperature, wherein the determination portion determines, as the target temperature, a first target temperature when the image end position is located at a position same as one end of a predetermined toner image in the main scanning direction, the predetermined toner image having a maximum size formable on the recording material, and the determination portion determines, as the target temperature, a second target temperature lower than the first target temperature when the image end position is located further toward a center side of the recording material in the main scanning direction than a position of the one end of the predetermined toner image, the predetermined toner image having the maximum size formable on the recording material.

11. An image forming apparatus, comprising:

an image forming portion configured to form a toner image on a recording material according to image information on a predetermined image;

a fixing portion configured to fix the toner image on the recording material by heating the recording material having thereon the toner image while conveying the recording material by a nip portion;

at least one processor; and at least one memory, the at least one memory storing instructions that, when executed by the at least one processor, cause the at least one processor to function as an acquisition portion that acquires an image end position that is a position of one end of the toner image in a main scanning direction perpendicular to a conveying direction of the recording material;

a determination portion that determines a target temperature based on the image end position; and a control portion that controls the fixing portion based on the target temperature, wherein the recording material is one of a plurality of recording materials, and the plurality of recording materials include a first recording material having a maximum size of fixation by the fixing portion in the main scanning direction and a second recording material having a smaller size than the maximum size in the main scanning direction, the determination portion determines, as a first interval, a conveying interval between sheets of the second recording material when the image end position is located at a position same as one end of a predetermined toner image in the main scanning direction, the predetermined toner image having a maximum size formable on the second recording material, and the determination portion determines, as a second interval shorter than the first interval, a conveying interval between sheets of the second recording material when the image end position is located further toward a center side of the second recording material in the main scanning direction than the one end of the predetermined toner image, the predetermined toner image having the maximum size formable on the second recording material.

* * * * *